US005327976A

United States Patent [19]

Hattori

[11] Patent Number: 5,327,976

[45] Date of Patent: Jul. 12, 1994

[54] METHOD OF INSTALLING PIPES FOR SPRINKLER HEAD MOUNTING, AND SPRINKLER-HEAD MOUNTING PIPING ARRANGEMENT

[76] Inventor: Takamasa Hattori, 218-315 Ogaito Oazu Kumatori-cho, Sennan-gun, Osaka-fu, Japan

[21] Appl. No.: 140,818

[22] Filed: Oct. 21, 1993

Related U.S. Application Data

[63] Continuation of Ser. No. 607,317, Oct. 31, 1990, abandoned.

[30] Foreign Application Priority Data

Apr. 23, 1990 [JP] Japan ..... 2-106950

[51] Int. Cl.[5] ..... A62C 35/68

[52] U.S. Cl. ..... 169/43; 169/16; 285/150

[58] Field of Search ..... 169/16, 43; 239/565; 285/150, 152

[56] References Cited

U.S. PATENT DOCUMENTS

| | | | |
|---|---|---|---|
| 1,850,937 | 3/1932 | Messinger | 285/150 X |
| 2,017,841 | 10/1935 | Coleman | 169/16 X |
| 2,654,346 | 10/1953 | Goff | 285/150 X |
| 3,666,015 | 5/1972 | Livingston | 169/16 X |
| 3,727,694 | 4/1973 | Dudzik | 169/16 X |
| 3,736,955 | 6/1973 | Schlesser | 285/150 X |

*Primary Examiner*—David M. Mitchell
*Assistant Examiner*—Andrew C. Pike
*Attorney, Agent, or Firm*—Koda and Androlia

[57] ABSTRACT

A method of installing sprinkler-head mounting pipes for supply of water to sprinkler heads employed for a fire water release system and a piping arrangement for sprinkler-head mounting wherein the joints each have at least two outlet ports and sprinkler heads are coupled to the outlet ports via flexible pipes.

5 Claims, 5 Drawing Sheets

METHOD OF INSTALLING PIPES FOR SPRINKLER HEAD MOUNTING, AND SPRINKLER-HEAD MOUNTING PIPING ARRANGEMENT

This is a continuation of application Ser. No. 607,317, filed Oct. 31, 1990, now abandoned.

BACKGROUND OF THE INVENTION

1. Field of the Invention

This invention relates to a method of installing pipes for sprinkler head mounting, and sprinkler-head mounting piping arrangement. More particularly, the invention relates to a method of installing sprinkler-head mounting pipes for supply of water to sprinkler heads employed for fire water release, and piping arrangement for sprinkler head mounting.

2. Description of the Prior Art

Generally, sprinkler heads of this type are arranged in plurality in spaced apart relation so as to enable fire water release to spread generally over the entire room space. Hitherto, it has been known to install pipes for sprinkler head mounting in manner as shown in FIGS. (5*a*), (5*b*), and 6, for example.

The conventional piping arrangement shown comprises a plurality of auxiliary water-supply pipes 5 led from and arranged in intersecting relation to a main supply pipe 1, and mounting members such as tees 16, elbows 17, and nipples 18 for mounting a plurality of sprinkler heads 15 at specified intervals to each auxiliary water-supply pipe, the mounting members being arranged in a suitable combination between each auxiliary pipe and each individual sprinkler head 15 as shown in FIG. 6.

SUMMARY OF THE INVENTION

In the conventional pipe installing method, it is necessary that each auxiliary pipe 5 must be provided with such number of branch pipes that corresponds to the number of sprinkler heads 15 to be mounted in position, and moreover, as stated above, a large number of parts are required in pipework for connection between each auxiliary pipe 5 and individual sprinkler heads 15. As such, the required piping arrangement is very complicated, and such complicated pipework is required with respect to individual sprinkler heads. This poses a fatal problem that the pipe installing work at the site is very complex and troublesome.

This invention has been developed with a view to solving the foregoing problem with the prior art, and accordingly it is a primary object of the invention to provide a simplified piping arrangement for sprinkler head mounting thereby to minimize the number of parts required for pipe installation and enable a series of pipework at the site to be carried out at ease and quickly.

In the method of installing pipes for sprinkler head mounting according to the invention, it is only required that sprinkler heads are individually connected through flexible joint pipes to joints each having at least two outlet ports which are connected to each auxiliary pipe.

Use of such joints makes it possible that one water supply line branched from each auxiliary pipe is connected to at least two sprinkler heads. Therefore, it is not necessary to equip each auxiliary pipe with branch pipes in corresponding relation to individual sprinkler heads as conventionally required; and in addition the number of auxiliary pipes can be reduced. Thus, the piping arrangement as a whole can be simplified and individual pipes required can also be simplified. As a result, a series of pipe installing works involved can be much simplified and very efficiently executed.

Furthermore, the use of flexible joint pipes for connection between the joints and the sprinkler heads affords easy placement of each individual sprinkler head in a desired position and ease of sprinkler handling, thus facilitating the execution of the required pipework.

The resulting piping arrangement, which carries a plurality of sprinkler heads, provides good practical convenience and involves a reduced number of parts as compared with the prior art piping arrangement, thus contributing much toward simplified pipe installing operation.

BRIEF DESCRIPTION OF THE DRAWINGS

FIG. 1(*a*) is a schematic plan view showing a pipe arrangement representing the embodiment; FIG. 1(*b*) is a schematic perspective view thereof;

FIG. 5(*a*) is a schematic plan view thereof; FIG. 5(*b*) is a schematic perspective view thereof; and a FIG. 6 is a fragmentary enlarged perspective view thereof.

DETAILED DESCRIPTION OF THE PREFERRED EMBODIMENTS

One example of the method of installing pipes for sprinkler head mounting according to the invention will now be described with reference to the accompanying drawings.

Figure 1B:
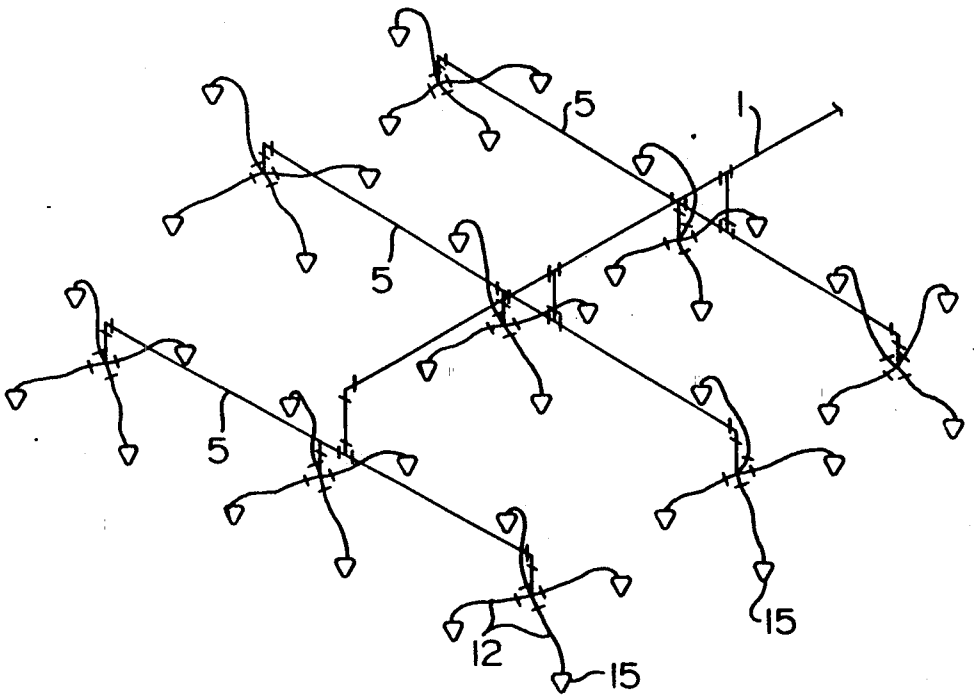
FIGS. 1(*a*) through 4 illustrate one embodiment of the invention.
Figure 1A:
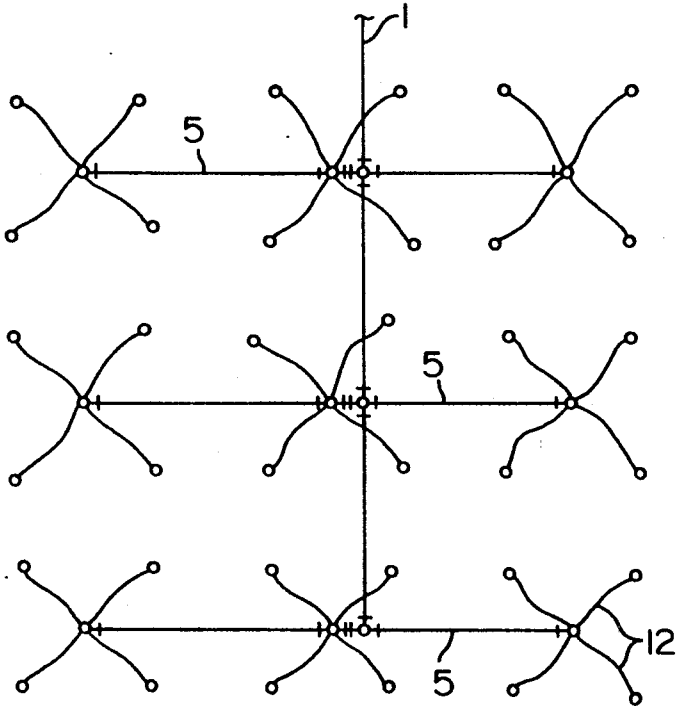
Figure 2:
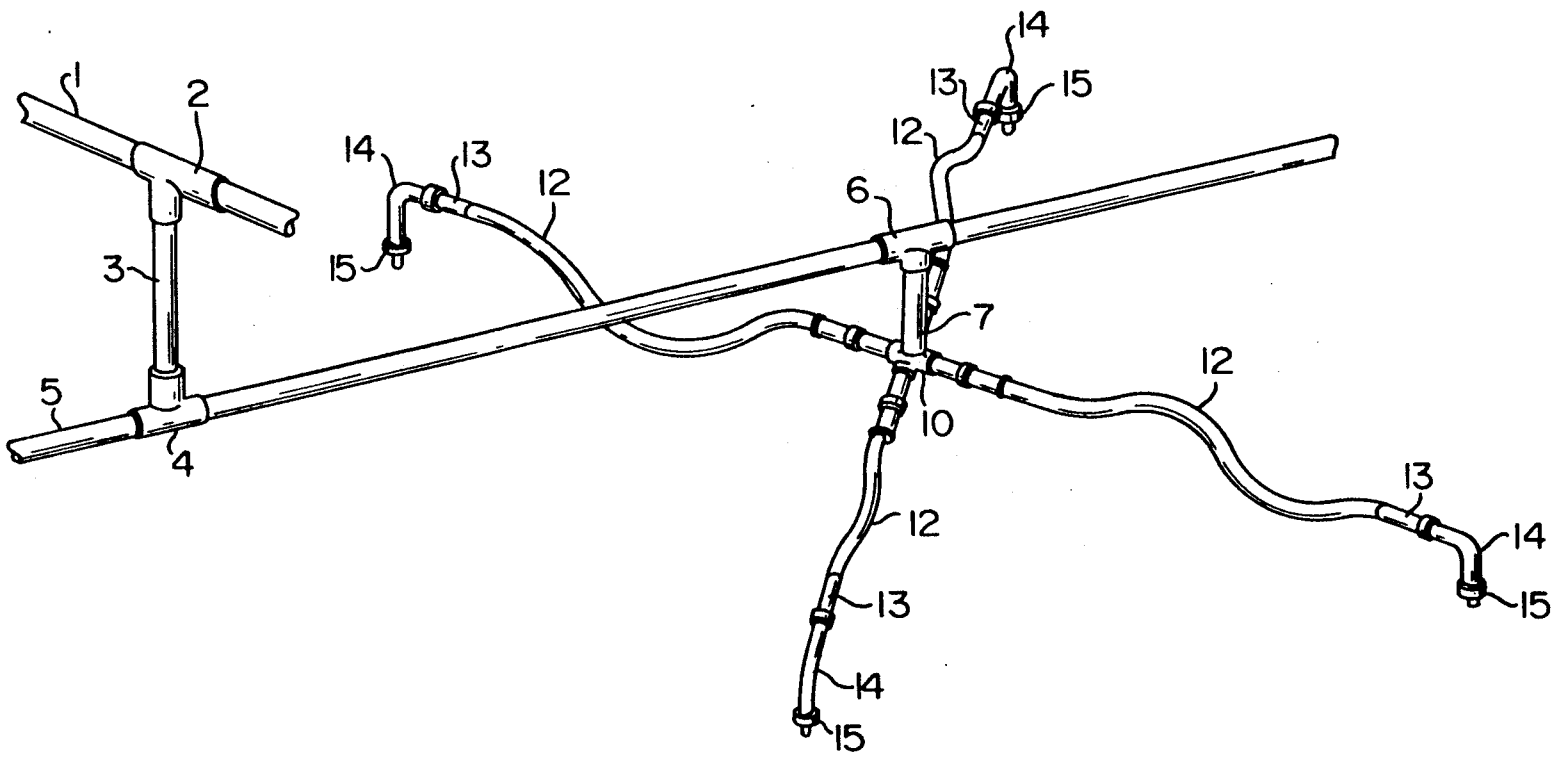
FIG. 2 is a fragmentary enlarged perspective view thereof.

As FIG. 2 shows, nipples 3 are first connected individually to tees 2 which are connected at specified intervals to a fire-water main supply pipe 1 installed in the ceiling of a house, and to each of the nipples 3 is in turn connected an auxiliary water-supply pipe 5 through a tee 4. A plurality of auxiliary water-supply pipes 5 are arranged in parallel to one another and in intersecting relation to the main supply pipe 1 as shown in FIGS. 1(*a*) and 1(*b*).

Figure 3:
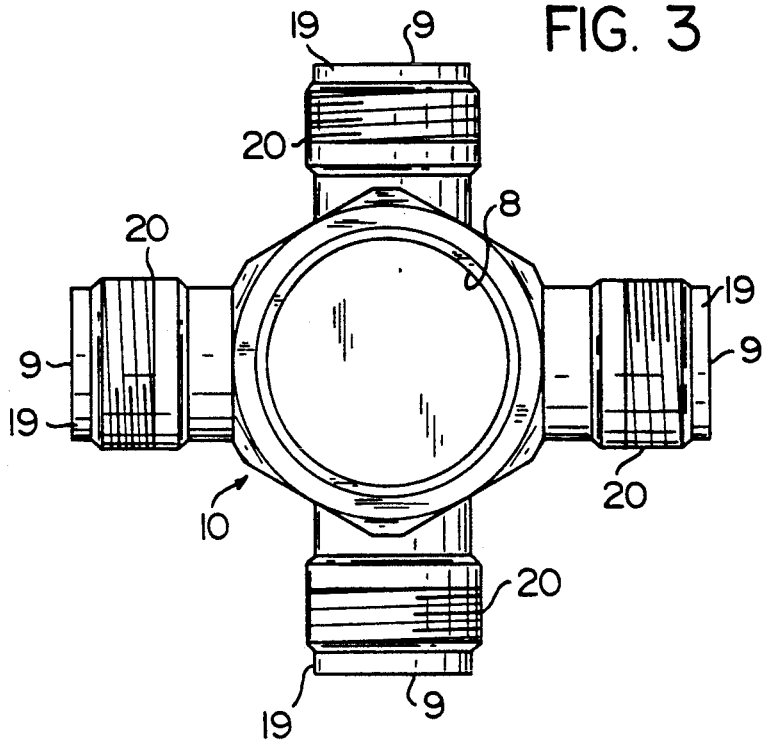
FIG. 3 is a plan view showing a five-port connection joint.

Then, tees 6 are incorporated into each auxiliary supply pipe 5 at specified intervals, and to each tee 6 is connected an inlet port 8 of a so-called five-port connection joint 10 through a nipple 7. Such a joint 10, as FIG. 3 shows, comprises the inlet port 8, which is formed generally centrally of the joint, and four outlet ports 9 formed in a cross pattern, each outlet port 9 being formed on its outer periphery with an externally threaded portion 20 having a cylindrical portion 19 at the front end thereof.

Figure 4:
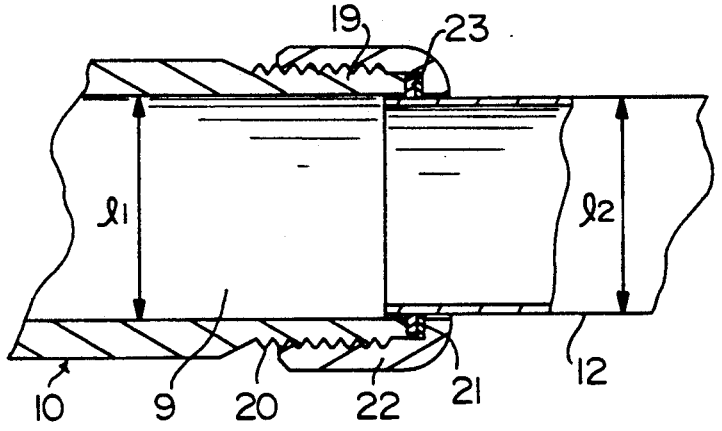
FIG. 4 is a sectional view showing a connection between the five-port connection joint and a flexible joint pipe.
Figure 5B:
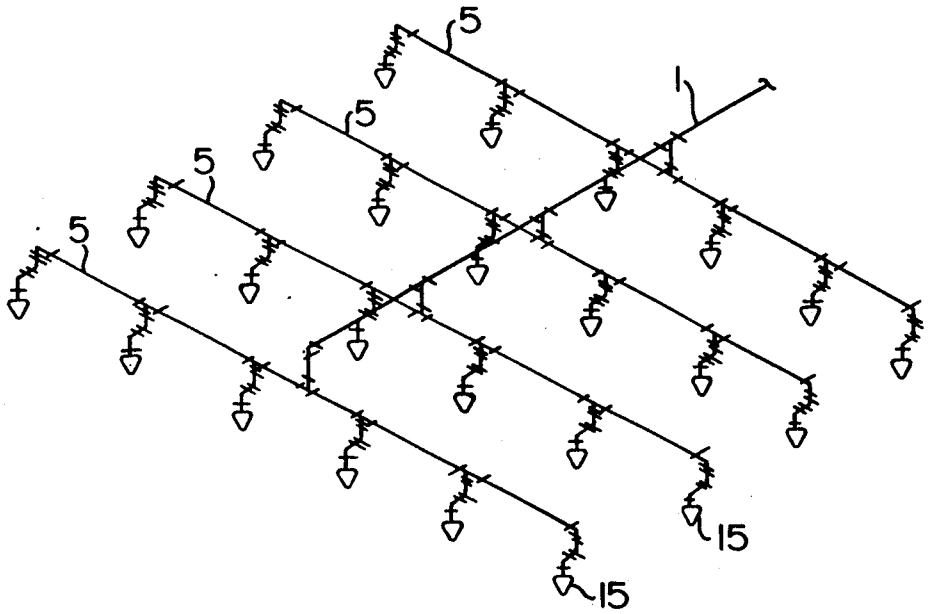
FIG. 5(b) PRIOR ART
FIGS. 5(*a*), 5(*b*), and 6 illustrate a prior art arrangement.
Figure 5A:
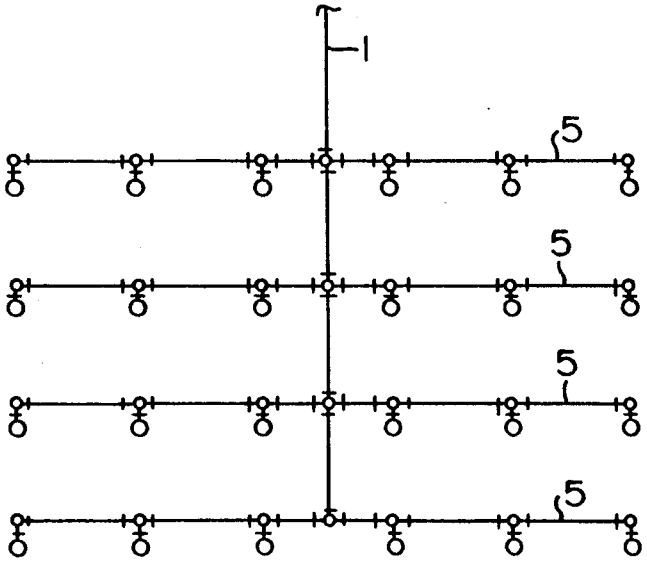
FIG. 5(a) PRIOR ART
Figure 6:
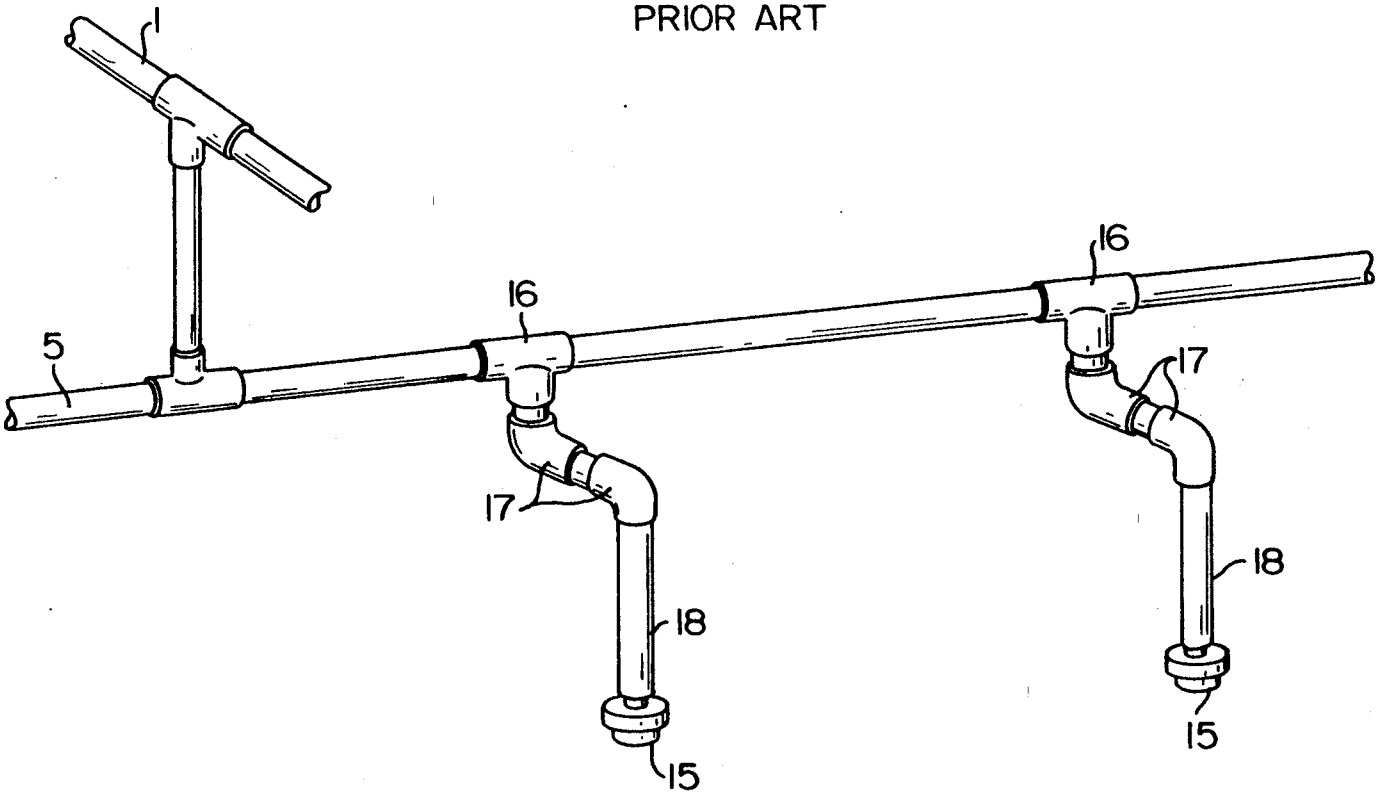
FIG. 6 PRIOR ART

Then, a thin-walled flexible joint pipe 12 having good flexibility is connected to each of the outlet ports 9, the flexible joint pipe 12 being formed on its outer periphery at one end with a circumferentially extending protrusion 21 as shown in FIG. 4. The flexible joint pipe 12 is passed through a hole of an annular member 22 for thread engagement with the externally threaded portion 20 of one outlet port 9 of the five-port connection joint 10 through an O-ring 23, whereupon the flexible joint pipe 12 is connected at one end to the one outlet port 9 of the five-port connection joint 10, with both the protrusion 21 of the flexible joint pipe 12 and the O-ring 23 being interposed between the front end of the one outlet port 9 and the annular member 22. According to this arrangement, flexible joint pipes 12, each having an inner diameter $l_2$ almost equal to the inner diameter $l_1$ of the five-port connection joint 10, can be connected to each respective five-port connection joint 10, and this provides an advantage that pressure loss due to pipe inner-diameter reduction can be inhibited which may otherwise be a cause of unreasonable drops in the rate of fire water flow.

Where a joint pipe 13 has previously been connected to the other end of each flexible joint pipe 12, with a sprinkler head 15 connected to the joint pipe 13 through an elbow 14, it is only necessary to bring the annular member 22 into thread engagement with the externally threaded portion 20 of the flexible joint pipe 12. This affords reduction of required work time at the site.

Sprinkler heads 15 are fixedly mounted in position on the ceiling or the like through the intermediary of elbows 14, etc. In this case, the fact that pipe portions of the flexible joint pipes 12 are quite flexible and light is particularly advantageous in that they are very easy to handle; they can simply be trained over the ceiling without use of any hanger means.

Necessary piping work for sprinkler head mounting is completed through the foregoing procedure and, as a result, a pipe arrangement is obtained such that four water-supply outlets are branched from one water-supply outlet in each auxiliary pipe 5, with four sprinkler heads 15 individually mounted to the branched water-supply outlets.

When fire water is supplied to the main supply pipe 1, the fire water is supplied to the sprinkler heads 15 via the auxiliary supply pipes, five-port connection joints, and flexible joint pipes 12 and is in turn released from the sprinkler heads 15.

In the present example, as described above, each auxiliary pipe 5 branches, at each specified point, in four directions through the intermediary of one five-port connection joint 10, and accordingly four sprinkler heads 15 can be mounted for each group of such four branches. This eliminates the necessity of providing branch pipes extending from each auxiliary pipe 5 in corresponding relation to the required number of sprinkler heads 15 and affords reduction in the number of auxiliary pipes 5. The necessity of providing discrete complex piping means is also eliminated.

Therefore, the required piping arrangement for sprinkler head mounting is simplified as a whole, which enables reduction in the number of parts required and affords easy and prompt execution of installing works involved. Thus, the invention provides a further advantage that piping repairs and other maintenance and inspection operations can be carried out at ease.

In the foregoing example, five-port connection joints 10 are employed to branch water supply in four directions, but it is to be understood that the configuration of such joint according to the invention is not limited to the one shown and may be suitably changed or varied according to the location, object, etc. for which such joint is to be used. It is only required that such joint should have at least two outlet ports.

It is also to be understood that the piping arrangement for water supply from auxiliary water-supply pipes 5 to sprinkler 15 is not limited to the one shown; inasmuch as the arrangement is such that sprinkler heads 15 are connected through flexible joint pipes 12 to auxiliary supply pipes 5, it is within the scope of the invention.

Other design details including the piping arrangements as to main supply pipe 1 and auxiliary supply pipes 5, and the configuration of flexible joint pipes 12, may be freely varied within the intended scope of the invention.

What is claimed is:

1. A method of installing pipes for sprinkler head mounting which comprises:

connecting a plurality of auxiliary water-supply pipes to a fire-water main supply pipe with spacing from each other;

connecting a plurality of joints to said auxiliary water-supply pipes with spacing from each other through an inlet port formed substantially centrally of each of said joints, each of said joints further having at least four outlet ports formed radially and horizontally on an outer periphery of said joints and extending in at least four different radial directions;

connecting a sprinkler head to each of said four outlet ports of each said plurality of joints through a flexible joint pipe in such a manner as to radially dispose said sprinkler heads at predetermined positions, using flexibility of said flexible joint pipe.

2. A method of installing pipes for sprinkler head mounting as set forth in claim 1, further providing a joint pipe connected between said flexible joint pipe and a corresponding one of said sprinkler heads.

3. A sprinkler head mounting piping arrangement for connecting sprinkler heads to auxiliary water-supply pipes connected to a fire-water main supply pipe with spacing from each other comprising:

a plurality of joints connected to said auxiliary water-supply pipes with spacing from each other through an inlet port formed substantially centrally of each of said joints, each of said joints further having at least four outlet ports radially and horizontally formed on an outer periphery thereof and extending in at least four different radial directions, each of said sprinkler heads connected to each of said four outlet ports of said joints through a flexible joint pipe in such a manner as to radially dispose said sprinkler heads at predetermined positions, using flexibility of said flexible joint pipe.

4. A sprinkler head mounting piping arrangement as set forth in claim 3, further comprising a joint pipe connected between one of the flexible joint pipes and a corresponding one of said sprinkling heads.

5. A sprinkler head mounting piping arrangement as set forth in claim 3, further comprising:

an externally threaded portion formed on the outer periphery of each said outlet port of each said joint, a protrusion formed circumferentially on an outer periphery of each said flexible joint pipe at one end thereof, and an internally threaded annular member fitted on each said flexible joint pipe, said annular member on each said flexible pipe joint being in thread engagement with the externally threaded portion of each said outlet port of each said joint, with a front surface of said protrusion being in abutment against a front end of each said outlet port of each said joint.

* * * * *